United States Patent [19]

Villa

[11] 4,145,897

[45] Mar. 27, 1979

[54] HOOK NEEDLE TYPE KNITTING MACHINE

[76] Inventor: Carlo Villa, Via Mazzini 43, Melzo (Milan), Italy

[21] Appl. No.: 863,145

[22] Filed: Dec. 21, 1977

[30] Foreign Application Priority Data

Dec. 28, 1976 [IT] Italy ..... 30905 A/76

[51] Int. Cl.[2] ..... D04B 23/00; D04B 27/00

[52] U.S. Cl. ..... 66/207

[58] Field of Search ..... 66/203, 204, 207, 208

[56] References Cited

U.S. PATENT DOCUMENTS

| | | | |
|---|---|---|---|
| 2,428,405 | 10/1947 | Young | 66/208 |
| 2,562,034 | 7/1951 | Hannay | 66/204 |
| 3,587,252 | 6/1971 | Kohl | 66/207 |
| 3,587,254 | 6/1971 | Kohl | 66/207 |

FOREIGN PATENT DOCUMENTS

| | | | |
|---|---|---|---|
| 262309 | 1/1971 | U.S.S.R. | 66/204 |

*Primary Examiner*—Ronald Feldbaum
*Attorney, Agent, or Firm*—Michael J. Striker

[57] ABSTRACT

The hook needle type knitting machine for the manufacture of ribbons comprises weft thread guiding means which include a pair of vertically movable side plates which support for axial movement at least one bar supporting the weft guides. The bar has a circular cross-section and is protected against inflections and rotation about its axis by an intermediate clamping member and a guiding rod slidably passing through a side plate. The guiding rod is secured to the bar by clamps which act as a thrust member for driving cam mechanism of the bar. The side plates and the needle bed are driven respectively, by a linkage including a driving eccentric shaft and a connecting rod. The needle bed is supported on two pivotable arms the length of which substantially exceeds the arcuate displacement of the needles so that this displacement can be considered as rectilinear.

9 Claims, 8 Drawing Figures

HOOK NEEDLE TYPE KNITTING MACHINE

BACKGROUND OF THE INVENTION

The present invention is related to a hook needle type knitting machine improved in order to raise remarkably its work speed.

Hook needle type knitting machines are textile machines comprising a bed of hook needles performing a reciprocating movement, so that the hook needles also perform an axial reciprocating movement. Each hook needle is fed by a respective warp thread that is moved substantially axially relative to the hook needle and guided by a corresponding thread guide.

All thread guides are disposed in parallel and are carried by a traverse having substantially a rotational movement, such as to induce each thread guide to lay, above the respective advanced hook needle, the respective warp thread. The hook needles slide in respective seats, the ends of which form the shoulder for the discharge of the loops formed by the assigned hook needles.

In to such an arrangement the hook needles execute parallel loop chains and, at each loop, such chains are linked, by a weft that is laid on the warp threads before the hook needles execute their loop chain forming movement, so as to link the same weft in the successively executed loops.

Machines of this kind allow to lay, not only a weft thread, but also rubber threads and additional wefts to effect various types of fabrics with or without design.

The laid wefts and threads are guided by weft guides and thread guides carried by bars parallel to the bed of the hook needles. The bars have necessarily a limited stroke and, therefore these machines are employed mainly to knit simultaneously juxtaposed ribbon-type fabrics having the width of a few centimeters, the number of the ribbons produced depending from the width of the bed and the width of the single ribbons being processed.

The most serious disadvantage of these machines is a considerably reduced speed relative to the other types of textile machines used for the production of ribbon fabrics, and an increase of speed thereof, such as to render them competitive with other machines, is very appreciated in the art, above all because the hook needle type knitting machines are simpler and less expensive machines.

The main reasons of the speed limitation of these machines can be found in the form of the bars carrying the weft guides or the thread guides and in the kinematic connections that move respectively the bed of the hook needles and the guide said plate of said bars, in their raising and lowering movement and in the mechanism moving the same bars.

The bars, in fact, have a flattened rectangular section and therefore a limited inertia moment, and can be easily inflected due to sudden inversions of speed, so that above a certain speed they are caused to vibrate in such a way that the thread guides and the warp guides, are carried out of register, rendering practically impossible the operation of the machine.

The vertical movement of the side plates, anyway, is realized by a cam mechanism. This results in a considerable friction and it is necessary to maintain the rotation speed within enough certain limits to avoid the quick wear and the vibrations.

In a similar way the movement of the bed is effected by cams, with the same above cited inconveniences.

Another reason of the speed limitation of the hook needle type knitting machines is given by the mechanism for the axial reciprocated displacement of the bars. Such prior art mechanism includes a cam acting on a pin coaxial to the respective bar and placed in contact with the latter through a coaxial screw screwing into the bar and the flat head of which was in contact with the flat end of said pin. The contact, between the flat surfaces was subject of transversal slidings which caused fast wear of the flat faces in contact and then the need of frequent replacements.

SUMMARY OF THE INVENTION

The present invention eliminates the above cited inconveniences and provides for a knitting machine of the above described type which has a substantially increased operational speed.

According to the present invention, the raising movement of the side plates is obtained by a mechanism comprising a toggle disposed in such a way as to work between a bent position, wherein the side plate is lowered, and a straight position wherein the side plate is raised, the intermediate hinge of said toggle being moved by a connecting rod reciprocated by an eccentric, said eccentric being in a phase such that it covers an arc around the forward dead center when the toggle is straightened so as to allow the side plate to be kept raised for a certain time, sufficient to permit the movement of the bars which is necessary to extend the respective wefts above the advanced hook needles.

The bars have a round section and are provided at least with an intermediate guide so to avoid flections produced by sudden inversions of speed.

Further devices are provided preventing from the rotation of the bars around their own axis.

The bed of the hook needles is supported by two elongated vertical arms hinged to the lower ends, each of said arms performing a reciprocating movement by a connecting rod moved by an eccentric and the base of which is substantially near the bed, so that the bed, while being moved by a linkage, executes a reciprocated movement that, while being arcuate, can be really considered straight-line owing to the lenght of the arms.

Further each bar is axially displaced by a swinging arm, shaped in a way to a follower contacting an eccentric cam and a follower contacting a flat end surface of the same bar, so to eliminate any reason of sliding and wear.

These features and others will become more apparent from the specification of the hereinbelow described embodiment, shown with reference to the enclosed drawings:

DESCRIPTION OF THE PREFERRED EMBODIMENTS

Figure 1:
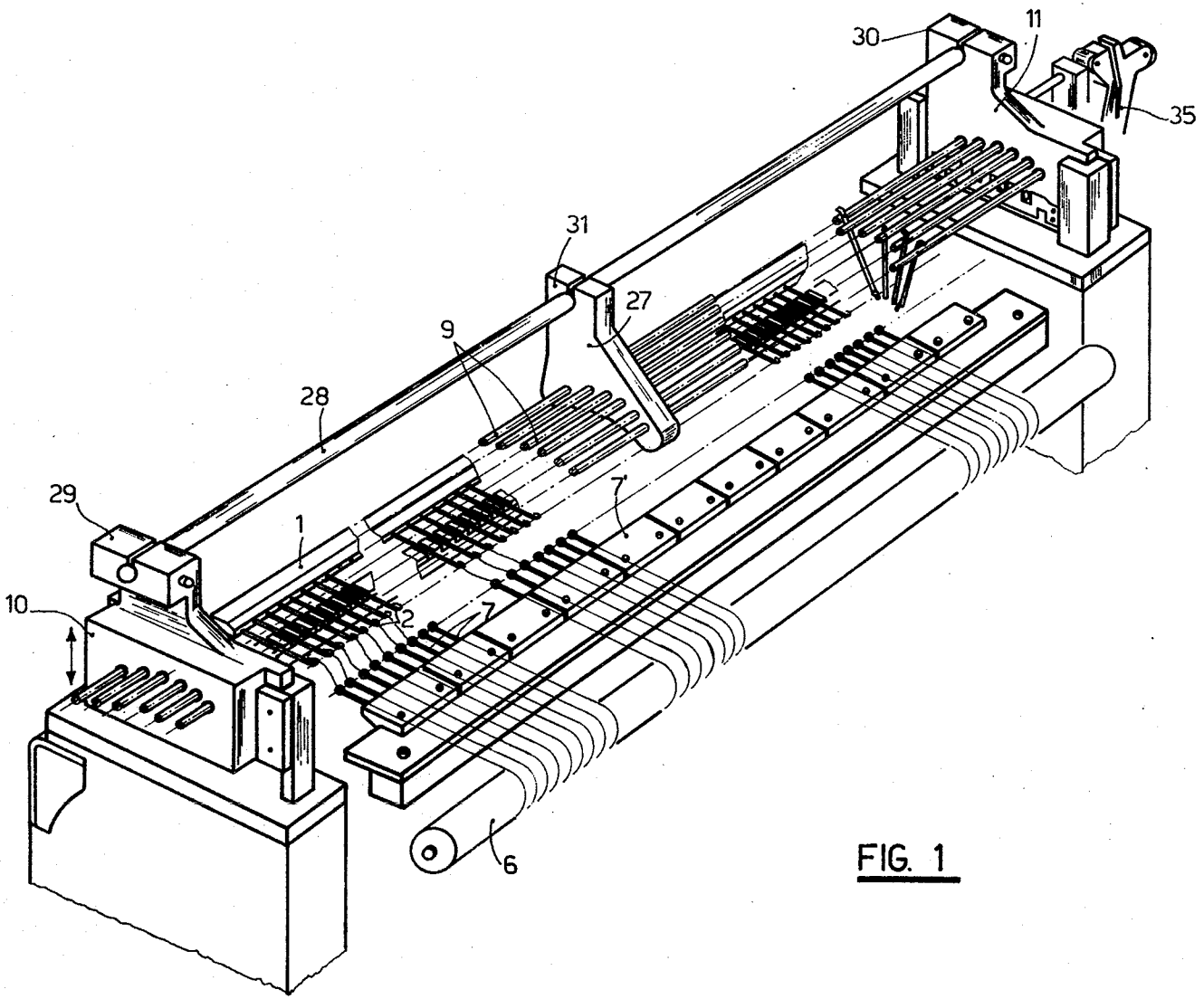
FIG. 1 shows a diagrammatic perspective view of the hook needle type knitting machine improved according to the invention.
Figure 2:
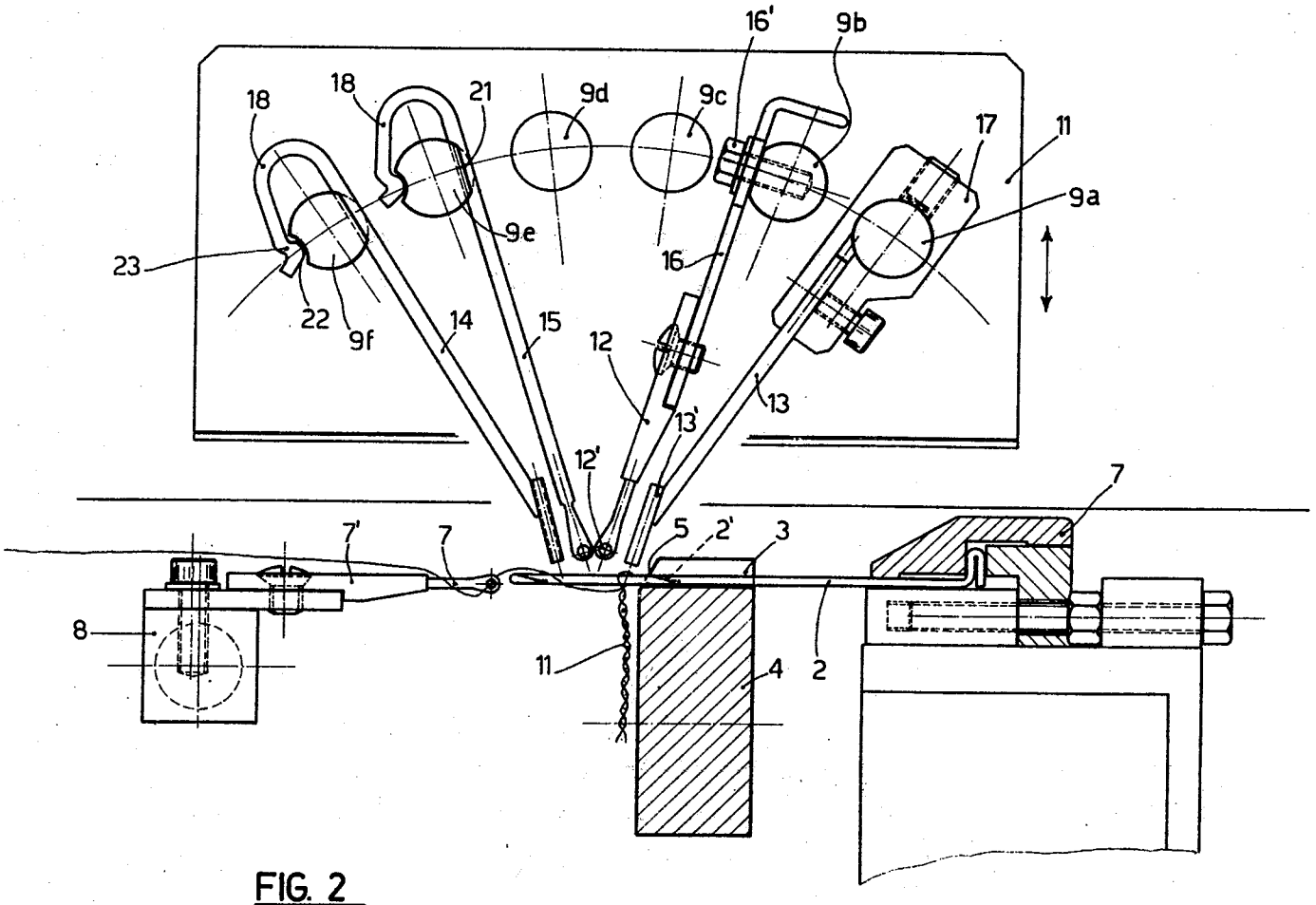
FIG. 2 shows a diagrammatic cross-sectional view of the machine, displaying the main operative members of the same machine.

As shown in FIGS. 1 and 2, the hook needle type knitting machine, in its known conception, includes a bed 1 from which project parallel arranged hook needles 2, which are preferably divided in equal groups of hook needles, each group being adapted for to the knitting of a ribbon having a predetermined width.

The bed 1 performs a a reciprocating movement, as to move the hook needles back and forth in an axial direction, the range of the movement being sufficient for enabling each hook needle to execute the loop chain from a respective thread. The hook needles are guided in respective grooves 3 provided on a fixed bar 4, the forward end 5 of each groove serving as a shoulder for the discharge of each successively formed loop, when the respective hook needle moves backwards to the position 2' indicated in dashed lines.

A warp beam 6 provided on the front portion of the knitting machine and parallel to the bed 1 feeds a warp consisting of a plurality of parallel warp threads, each thread being fed to an assigned hook needle and guided by a respective wrap thread guide 7. The thread guides 7 are parallel and are carried in groups by plate members 7', according to a known art, the plate members being on their turn mounted on a bar 8, so as to form a continuous reed or comb 6 of thread guides 7, extending over the entire length of the bar 8.

The bar 8 performs a rotating movement, in order to allow each thread guide 7 to wind its thread around the respective hook needle, when the latter is in an advanced position, in order to carry it in a position wherein it can be grasped by the hook of the same hook needle during its rearward stroke.

Above the hook needles 2, there are provided parallel bars 9*a* of 9*f* supported and guided by end side plates 10 and 11. In FIG. 1 the bars 9*a*–9*f* are shown for the sake of simplicity by dash-and-dot lines, but it is understood that said bars are continuous from a side plate to another and project beyond such side plates.

The side plates 10 and 11 are perform a vertical reciprocating movement synchronized with the movement of the hook needles 2, therefore when the hook needles are advanced, the side plates are raised, while when hook needles are retracted, the side plates are lowered.

Consequently the bars 9*a* to 9*f* are subject to the same vertical displacements of the side plates, displacing parallel relative to their axis.

The bars 9*a*–9*f* further perform a reciprocating axial movement, whose range varies from bar to bar for the reasons which will be explained hereinbelow.

The bar 9*a* is supports weft guides 13, whose structure is known, said weft guides ending with a tubular end 13' through which passes the main weft connecting the loops executed by the hook needles.

Each weft guide 13 is mounted on the bar 9*a* by means of a clamp 17 which, through a first screw 17', is tightened around the bar 9*a* and through a second screw 17" locks the weft guide 13.

On the bars 9*a* there are mounted as many weft guides 13 many parallel ribbons are in production and the range of the axial displacement of the bar 9*a* is equal to the width of the ribbons, so that each weft guide 13 can lay the respective weft across the whole width of the respective ribbon.

The weft guides 13 are always necessary for knitting the ribbons, because the wefts are laid by said weft guides are necessary for the base fabric formation by linking the loops simultaneously formed by the hook needles 2 for each responsive ribbon, according to a known art.

The bar 9*b* supports at least a plate 16 (FIGS. 2 and 3) extending parallel to the bar 9*b* and fixed on the latter by means of screws 16'. The plate 16 is provided with plate members 12, similar to the plate members 7', and provided with thread guides 12' in the form of eyes. The thread guides 12' serve to guide respective rubber threads employed in the case of knitting an elastic ribbon, and there are as many thread guides 12 as many hook needles 2 are employed. Each thread guide serves to carry the respective rubber thread alternatively either on the one side or on the other side of a respective hook needle, in order that said rubber thread be linked in the successive loops formed by the same hook needle.

Consequently the bar 9*b* has a reciprocating movement having a range equal to the sweep of the hook needles 2.

The other bars 9*c* to 9*f* are employed to support the weft guiding and thread guiding members known from prior art, and are readily mounted on the bars by means of clamps 18. By way of example: on the bar 9*f* are mounted weft guides 14 and on the bar 9*c* are mounted weft guides 15. The number of these additional members for each ribbon and the width of the travel of the respective bars can vary depending from the design which is desirable to obtain.

Further the registration of the clamps 18 takes place by means of juxtaposed seats, 21 and 22, provided on the respective bars, The fabric 19, as it is formed, descends vertically along the front wall of the bar 4 in order to be subsequently wound on a beam.

All above described parts and to the operation of the machine, have to be understood as known art and therefore not entering the field of the invention.

As shown in FIGS. 1 to 5, the bars 9*a* to 9*f* have, according to the invention, a circular cross-section in order to increase their inertia moment.

The rods 9 have a perfectly circular section in the middle portion 24 and in the two end portions 25 and 26 which pass through the side plates 10 and 11. To run force the rods 9 there is provided an intermediate guiding support 27 carried by a strong traverse 28 which is supported between two clamps 29 and 30 provided respectively on top of the side plates 10 and 11, the support 27 being mounted on the traverse 28 by means of a clamp 31.

To avoid rotation of each single bar around its own axis, each bar is provided with two clamps 32 and 33 disposed respectively against both sides of the side plate 11. The clamps 32 and 33 are tightened on the assigned bar and carry at their downwardly directed ends a guide rod 34 extending parallel to the bar and passing through the side plate 11, thus forming a structure that prevents the bar from rotating around its own axis. In this way the angular position of the weft guides, is secured once the angular position of the bars has been adjusted and the weft guides have been mounted thereon.

The clamp 33 (FIGS. 3 and 8) has an outer flat surface on which presses a tappet follower 35' carried by the arm 35, pivotable around a pin 36 and reciprocated by a cam 37, for example an eccentric cam. The cam urges the respective bar, leftward against a counteracting spring 38, wound on the opposite end of the bar, beyond the side plate 10. The spring 38 acts between a shoulder 39 of the bar and a stop 40 provided with a central hole wherein the bar end, portion is slidably guided. The stop 40 is connected to a sleeve 41, fixedly tightened on a pin 42, projecting from the side plate 10 and extending parallel to the bar.

The employ of the bars having a round section, besides to increase their stiffness, allows to realize more precise and less expensive couplings with the circular holes 43 of the middle support and with the hole 45 of the side plates 10 and 11.

These precise couplings further strongly limit vibrations.

The stiffness of the bars is increased, besides their circular section, also by to the intermediate support and by the fact that such a support, the upper rod 28 and the side plates constitute a rigid guide structure.

With this improvements, the bars can be reciprocated with a substantially increased frequency than it was possible in the known machines.

Figure 3:
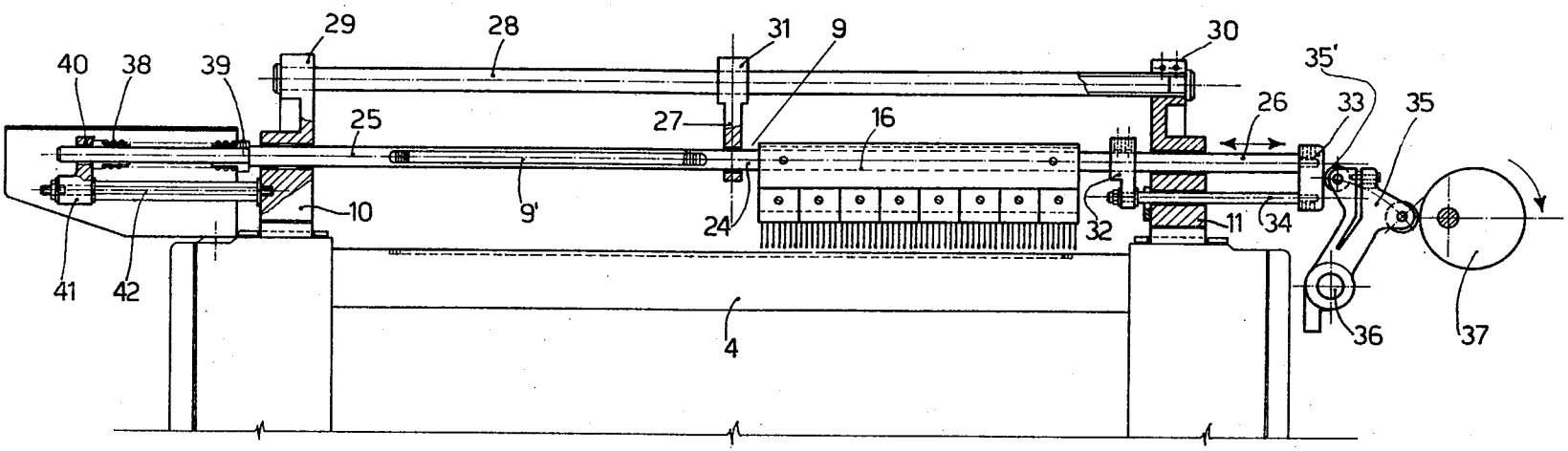
FIG. 3 shows a diagrammatic front view of the machine showing the movement of the guide of the bars carrying the weft-guides.
Figure 4:
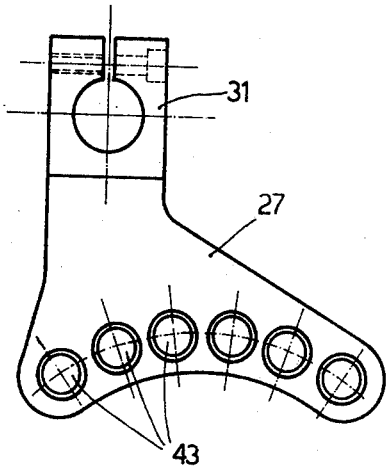
FIGS. 4 and 5 show respectively a middle support and a bar guide side plate.
Figure 5:
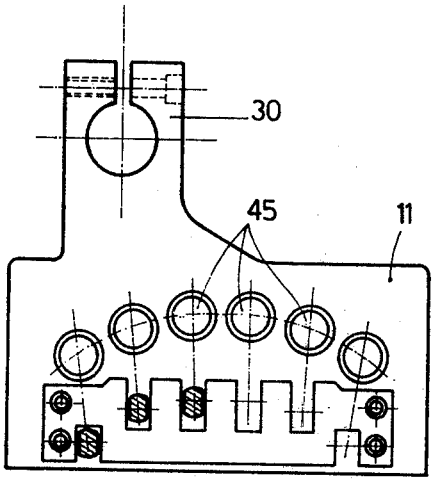
Figure 8:
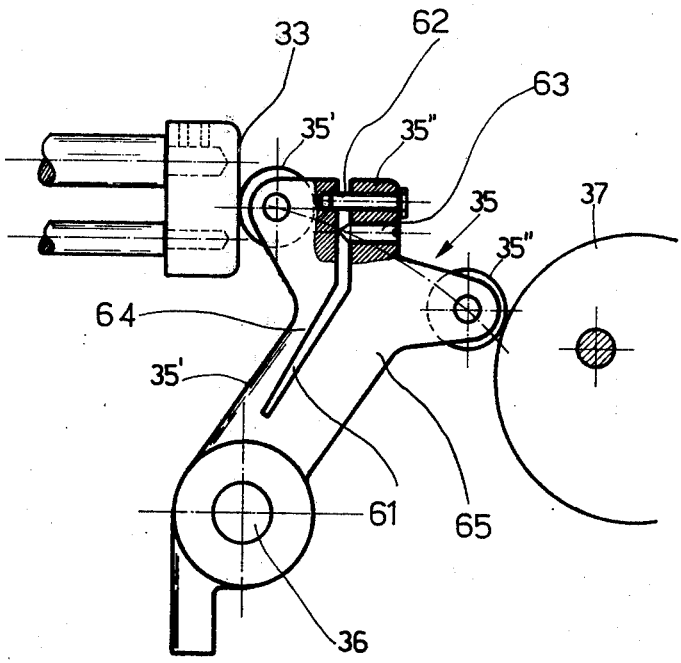
FIG. 8 shows the mechanism provided for the axial movement of the bars.

As shown in the FIGS. 3 and 8, arm 35 is provided with a slit 61 which begins from the upper end and extends nearly to the hub of the pin 36, in order to render elastically deformable at least the longitudinal portion 64 of the arm 35.

At the upper end of the slit there are provided a screw 62 and a dowel 63. The screw 62 passes through a hole of the portion 65 and is screwed in a blend hole of the portion 64, so that it serves to restrain the slit 61. The dowel 63 is screwed in a hole of the portion 65 and presses with its point against the opposed portion of the slit, so that its screwing serves to widen the slit 61.

The variation of the width of the slit 61 requires a distance variation between the contact point of the follower 35" with the eccentric 37, and the contact point of the follower 35' with the plane face of the clamp 33, allowing a consequent displacement of the respective bar.

In this way, the screw 62 and the dowel 63 are employed for a micrometric adjustment of the bar and of the weft guides or the thread guides, supported by the same bar.

The work speed obtainable from the bar 9 is subordinated to the work speed of the side plates 11 and 10, and the hook needles 2. Consequently if it is desirable to operate the knitting machine at a high speed, not only the bars, but also the side plates and the hook needles have to be operated and driven to work at that speed.

The thread guides supported by the front bar 8 do no have speed problems, because such a bar performs a rotational movement, and can be driven at any speed.

Figure 6:
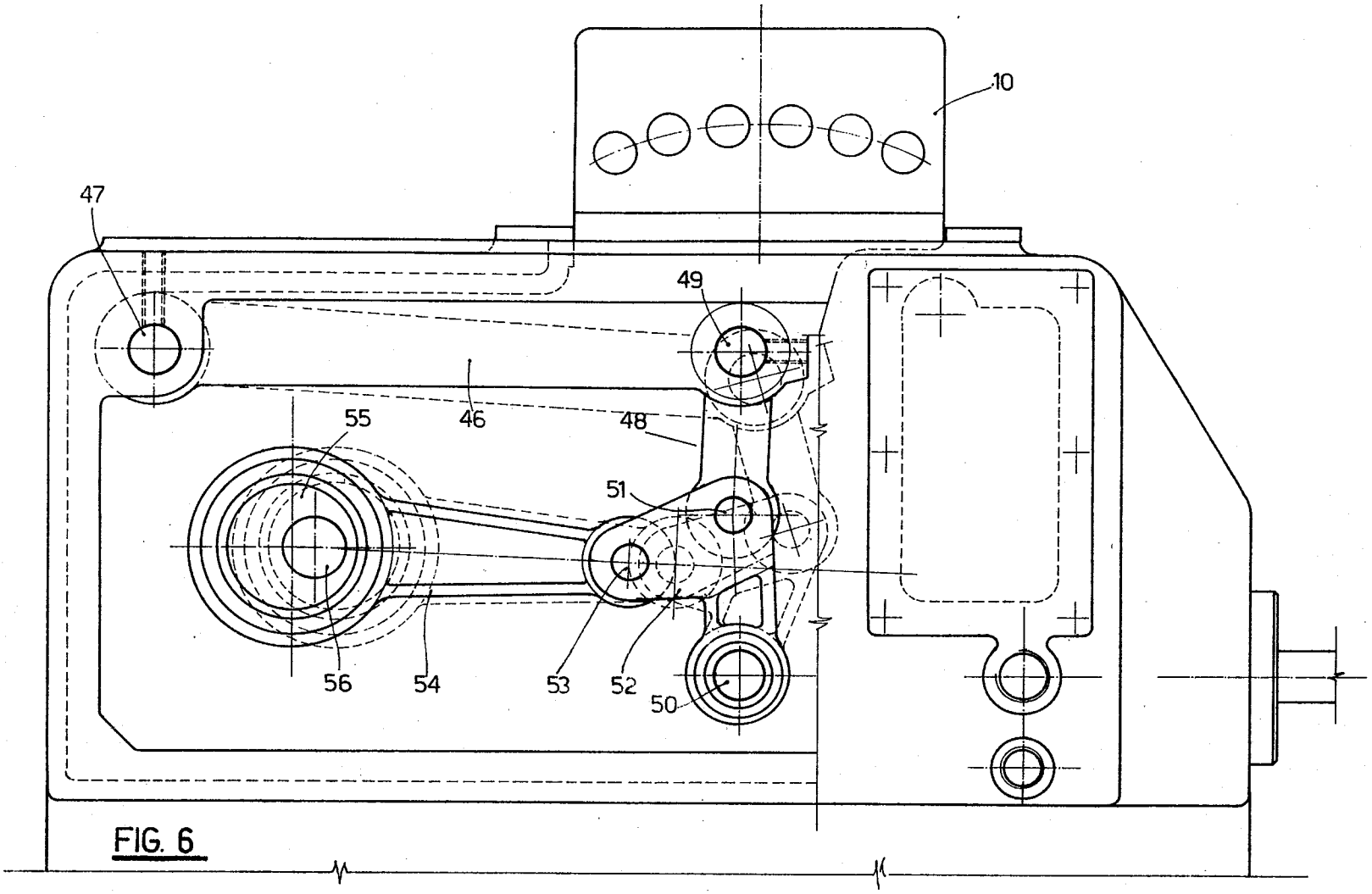
FIG. 6 shows the mechanism for the movement of a side plate.

According to the invention the cam mechanism for the control of the side plate is eliminated and, as shown in FIG. 6, each side plate is carried by an arm 46 pivotably supported on a pin 47 fixed at one end thereof on the frame of the machine. At the other end the arm is connected to a toggle 48 whose one end hinge 49 is pivotably connected to said arm 46 and the other end hinge is pivotably supported on a pin 50, fixed on the frame, and the intermediate hinge 51 is connected by means of a fork 52 to the pin 53 at the free end of a connecting rod 54 reciprocated by an eccentric shaft 55.

The sizing is realized in such a way that, when the connecting rod 54 is in the retracted position, the eccentric point 56 covers the arc around its forward dead center, the toggle is straightened (as shown in FIG. 6) with the three pins 49, 50 and 51 in alignment or with a small override of their alignment, while, when the connecting rod is in the advanced position the toggle is bent in the position shown in dashed lines.

The advantage of the mechanism shown in FIG. 6 consists not only in the elimination of the sliding contacts with the cams, but also in the fact that the connecting rod-eccentric transmission, even at high work speeds, involves accelerations and decelerations, without sudden inversions of speed, limitating thereby the inertia effects of the moving masses.

A further main advantage is given by the fact that the combination of the linkage with the toggle allows displacements and stops of the side plates which, while maintaining a high operational speed of the machine, allow the side plates to be maintained in the raised position and in the lowered position for a time sufficient to permit the displacements of the weft guides, without interfering with the hook needles.

It can be noted, in fact, that when the toggle is straightened as shown by full lines in FIG. 6, the eccentric covers front arc substantially perpendicular to the direction of movement of the connecting rod whereby the connecting rod executes the minimum axial displacement. This means that the toggle is practically straightened for a certain time sufficient to keep raised the side plate for the necessary time.

When the eccentric covers the upper or lower arc about parallel to the displacement of the connecting rod, it causes the fastest displacement of the connecting rod and then a fast movement of the toggle towards the bent position, or towards the straightening position. Further, when the eccentric covers the rear arc perpendicular to the direction of movement of the connecting rod, the toggle is kept in the bent position for a certain time, sufficient to keep lowered the side plate.

Figure 7:
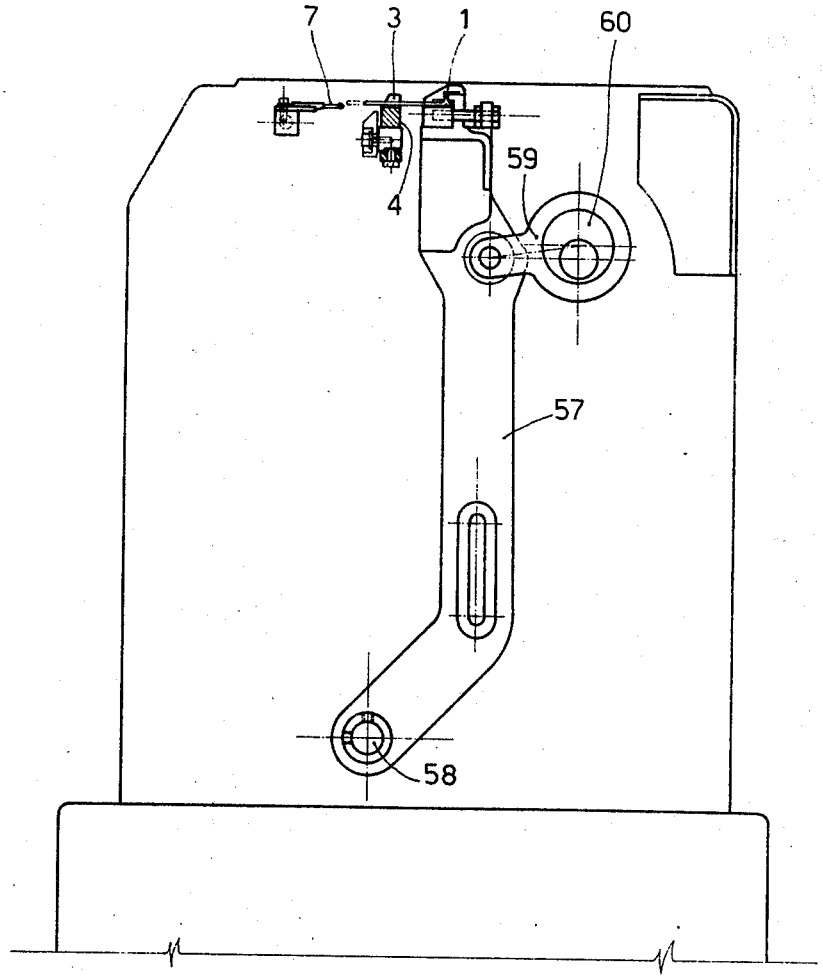
FIG. 7 shows the mechanism for the movement of the bed.

In order to allow the bed 1 of hook needles to be driven at a work speed equal to the one of the bars and the side plates, the two ends of the bar and the bed 1, as shown in FIG. 7, are supported by the upper ends of the two parallel arms 57 extending in a substantially vertical position, of which only one is visible, both arms have a considerable length and are pivotably connected at the lower end thereof to pins 58 fixed to the frame.

Due to the increased lenght of the arms 57 and the limitation of the range of their pivotal movement determined by the operational displacement of the hook needles, the latter draw an arc which can practically be considered rectilinear.

Near the bed of the hook needles, the arms 57 are caused to swing by a respective connecting rod 59 operated by an eccentric 60, the eccentricity being such as to induce the hook needles to a reciprocated movement having a displacement sufficient for their work. Also in this case, the introduction of the connecting rod-eccentric mechanism allows high work speed.

It has still to be noted that the novel features of the bars namely their circular cross section with their guide and stiffening means, the mechanism operating the same bars or the mechanism operating the side plates 10 and 11, and the mechanism operating the bed of the hook needles, must necessarily work in concert with each other to obtain high work speed rates, because the lack of one of them would not allow the achievement of the desired speeds. Such improvements, further, not only can constitute parts of newly designed machines but present the advantage to be employable even on machines already in operation, offering thereby remarkable economical advantages.

Of course the invention is not limited to the above shown embodiment, but can be subject to changes and variations within the scope of knowledge of a person skilled in the art, without thereby departing in any way from the spirit of the invention.

I claim:

1. In a knitting machine having a plurality of hook needles adapted for forming and discharging chains of loops for warp threads, a reciprocating bed adapted for movably supporting said hook needles, warp guiding means for guiding a warp thread to each of said needles, weft guiding means for guiding weft threads to link the loops in respective chains, and means for movably supporting said warp guiding means, a combination comprising: a pair of opposite side plates arranged for a vertical reciprocating movement above said needles and each defining at least one guiding passage of circular cross-section; at least one bar having a substantially circular cross-section and having its end portions slidably supported for axial movement in said guiding passages; said one bar supporting said weft guiding means for axial and vertical movements between a first level below said needles and a second level above said needles; an intermediate supporting memeber slidably supporting a central portion of said one bar to eliminate inflections of said one bar; a driving linkage for said side plates including a connecting rod and a toggle lever hinged between said connecting rod and one of said side plates; supporting means for said bed including a pair of elongated, swingable supported arms; and a driving linkage for said bed pivotably coupled to said arms.

2. A combination as defined in claim 1 further comprising means for preventing rotation of said one bar about its axis, said preventive means including an additional guiding passage in one of said side plates, a rod slidably passing through said additional guiding passage and extending parallel to said one box, and clamping means for securing said rod to said one bar.

3. A combination as defined in claim 2 wherein said clamping means defines a thrust surface, and further including reciprocating driving means for said one bar cooperating with said thrust surface.

4. A combination as defined in claim 1 further including a reinforcing rod clamped to said side plates and extending therebetween, said reinforcing rod fixedly supporting said intermediate supporting member.

5. A combination as defined in claim 1 wherein said driving linkage for said side plates includes a driving eccentric shaft slidably coupled to said connecting rod to displace said rod between a forward position in which said toggle lever and said side plates are elevated and a backward position in which said toggle lever and said side plates are lowered, the dwell of said side plates in said elevated and lowered position being sufficient for permitting the displacement of the weft guides on said one bar.

6. A combination as defined in claim 1 wherein the length of said arms for supporting said bed is substantially larger than the axial displacement of the needles in said bed, so that the arcuate path of movement of the needles of said bed resembles a rectilinear path; and said driving linkage for said bed including a driving eccentric shaft coupled through a connecting rod to said arms.

7. A combination as defined in claim 3 wherein said driving means for said bar includes spring means and a cam mechanism cooperating for imparting an axial reciprocating movement of said bar, said cam mechanism including an eccentric cam, a pivotable arm reciprocated by said cam and acting against said thrust surface in said clamping means.

8. A combination as defined in claim 7 wherein a cam follower is supported on the free end of said pivotable arm to provide contact between said cam and said thrust surface.

9. A combination as defined in claim 8 wherein said pivotable arm is provided with a longitudinal slit which renders at least the upper portion of said arm elastically deformable, and adjustment screw means arranged for adjusting the width of said slit, to vary the distance of the contact points of said cam follower between said cam mechanism and said thrust surface.

* * * * *